59-33 AU 247 EX
10/15/85 OF 4,546,626

United States Patent [19]

Zwaans

[11] Patent Number: 4,546,626

[45] Date of Patent: Oct. 15, 1985

[54] OVERLOAD-SECURITY FOR STAKING MACHINES FOR LEATHER INDUSTRY

[76] Inventor: Joseph Zwaans, Horiser Wald 78, 6780 Pirmasens 22, Fed. Rep. of Germany

[21] Appl. No.: 498,155

[22] Filed: May 25, 1982

[30] Foreign Application Priority Data

May 25, 1982 [DE] Fed. Rep. of Germany ... 8215136[U]

[51] Int. Cl.[4] ..... C14B 1/40

[52] U.S. Cl. ..... 69/33

[58] Field of Search ..... 69/34, 48, 33; 12/1 R

[56] References Cited

U.S. PATENT DOCUMENTS 585,212 6/1897 Jones ..... 69/34

1,744,420 1/1930 Stackpole ..... 69/34

2,571,149 10/1951 Maciejowski et al. ..... 69/48 X 2,596,125 5/1952 Campbell, Jr. ..... 69/34

FOREIGN PATENT DOCUMENTS 478705 3/1953 Italy ..... 69/34

*Primary Examiner*—Wm. Carter Reynolds

*Attorney, Agent, or Firm*—Pahl, Lorusso & Loud

[57] ABSTRACT

An overload security system for a leather staking machine is disclosed. The system employs a disk spring package in order to release the staking plates from their predetermined positions when a certain critical pressure is exceeded. The position of the staking plates is adjustable for different qualities of leather or different intensities of staking.

2 Claims, 1 Drawing Figure

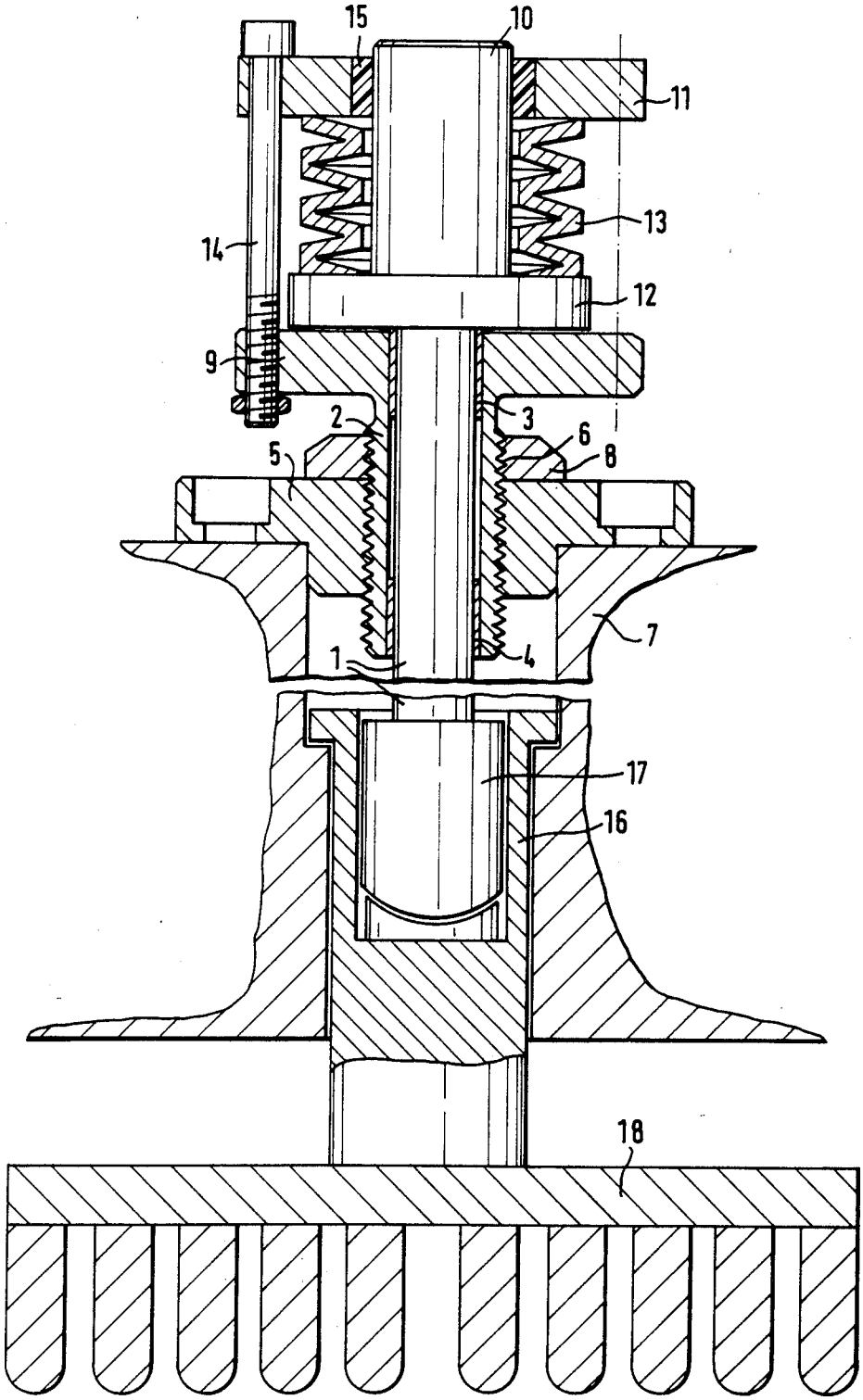
15
10
11
13
14
12
9
2
3
6
8
5
7
1
4
17
16
18

OVERLOAD-SECURITY FOR STAKING MACHINES FOR LEATHER INDUSTRY

BACKGROUND OF THE INVENTION

Staking machines have been used for some time to soften leather. The leather is softened by staking plates which vibrate into each other. The leather is transported between these staking plates while the plates are vibrating. One of the major problems associated with such machines is that the drives can become overloaded thereby leading to destruction of the machine. Overloads occur when very heavy, hard and/or uneven leathers are transported between the staking plates. Overloads can also occur when extraneous elements are passed between the staking plates.

In prior art staking machines, a shear pin is attached to the pressure heads of each staking plate in order to prevent overloading of the staking machine. The use of shear pins, however, slows down the softening process because each time a pin breaks the staking machine must be shut off so that the broken pin can be replaced. Using thicker and stronger shear pins will prevent the pins from breaking easily, but thicker and stronger shear pins cause the critical point of overload-power to be increased thereby subjecting the drive (crank shafts, staking plates, connection rods, beams, etc.) to possible damage or destruction.

There have been several attempts made to secure the pressure heads with hydraulic cylinders in order to eliminate the use of shear pins. Use of hydraulic cylinders, however, involves complicated constructions and mountings which result in very high costs. Therefore, the use of hydraulic cylinders is only economically feasible when the entire machine is working on a hydraulic base already. Otherwise, a complete hydraulic unit must be installed just to prevent overload.

It is therefore a principle object of the present invention to provide an overload-security system which is essentially trouble-free and which does not include complicated constructions and mountings.

SUMMARY OF THE INVENTION

The present invention provides protection against overloading of a stacking machine by providing a mechanical spring package which releases the staking plates or pressure heads once a certain critical line (identical to the original shear pins) is reached. This spring package includes disc springs which release the drive. This spring unit can be changed to any position of heights in order to reach different staking pressures for different types of leathers. These spring heads adapt themselves to desired pressures at each area of the leather thereby granting much better and individual staking results.

The machine is also equipped with a digital readout unit which allows permanent optical supervision thereby simplifying the adjustments for different pressures.

These and other features and objects will become apparent to those skilled in the art from the following detailed description which should be read in light of the accompanying drawing.

BRIEF DESCRIPTION OF THE DRAWING

The FIGURE is a cross-sectional view of the overload security device of the present invention.

DETAILED DESCRIPTION OF THE PREFERRED EMBODIMENT

In the embodiment of the overload security system of the present invention shown in the FIGURE, a power transmission piston 1 is guided in bushing 2 and supported in bearings 3 and 4. Bushing 2 is adjustable in height, by means of a thread 6, in the base plate 5. The base plate 5 is positioned in the upper beam 7 of the staking machine. A counter nut 8 locks the bushing 2 at the desired adjustable height. A digital readout unit (not shown) allows permanent optical supervision thereby simplifying the adjustments.

A flange 9 is positioned at the top of bushing 2, and a disk 11 surrounds the top end 10 of the power transmission piston 1 adjacent the flange 9. A disc-spring package 13 is located between disc 11 and flange 12.

Between disc 11 and flange 9 there are several connection screws 14. These screws are apportioned around the disc 11 and flange 9. A bearing 15 is placed in disc 11 at the top end 10 of the power transmission piston 1.

The power transmission piston 1 goes into an insert 17 which presses against member 16. Member 16 is screwed to the generally stationary staking plate which obtains the working pressure.

The power transmission piston 1 can be adjusted to the required height by means of the bushing 2 depending on the quality of the leather or the intensity of the staking. At overloading of the pressure the power transmission piston releases the staking plate by means of squeezing the disc-spring package 13 together so that a permanent overload of the drive is avoided.

Although this invention has been described with reference to the specific embodiments, it is understood that modifications and variations may occur to those skilled in the art. It is intended that all such modifications and variations be included within the scope of the appended claims.

What is claimed is:

1. An overload security system connected to a member for a non-vibrating plate of a leather vibration staking machine comprising:

a piston guided by a bushing having threads around its outer surface, one end of said piston being positioned so as to receive pressure from the member for the non-vibrating staking plate;

a base plate surrounding said bushing;

a counter nut positioned adjacent said base plate for threadably engaging said threads of said bushing for adjusting the position of said piston relative to said base plate;

spring means of a pre-selected strength positioned relative to said piston so as to be caused to compress when a predetermined critical pressure exerted on the piston is exceeded.

2. The overload security system of claim 1 wherein said spring means comprises a disk spring which surrounds said piston, said disk spring being positioned between a carrying disk and a flange connected to said piston.

* * * * *